US009228559B2

(12) United States Patent
Ikeda et al.

(10) Patent No.: US 9,228,559 B2
(45) Date of Patent: Jan. 5, 2016

(54) PLASMA GENERATION DEVICE

(75) Inventors: Yuji Ikeda, Kobe (JP); Minoru Makita, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 337 days.

(21) Appl. No.: 13/982,679

(22) PCT Filed: Jan. 31, 2012

(86) PCT No.: PCT/JP2012/052170

§ 371 (c)(1),
(2), (4) Date: Oct. 14, 2013

(87) PCT Pub. No.: WO2012/105570

PCT Pub. Date: Aug. 9, 2012

(65) Prior Publication Data

US 2014/0041611 A1 Feb. 13, 2014

(30) Foreign Application Priority Data

Jan. 31, 2011 (JP) ..... 2011-018692

(51) Int. Cl.
*F02P 23/04* (2006.01)
*F02M 27/04* (2006.01)
(Continued)

(52) U.S. Cl.
CPC ..... *F02P 23/045* (2013.01); *F02M 27/042* (2013.01); *H05H 1/46* (2013.01); *F02P 3/0407* (2013.01); *F02P 9/007* (2013.01); *F02P 17/00* (2013.01); *H05H 2001/463* (2013.01)

(58) Field of Classification Search
CPC ..... F02P 23/045; F02P 23/04; F02P 23/08; F02P 11/00; F02P 15/04; F02P 15/08; F02P 3/0407; F02P 7/02; F02P 9/007; F02P 9/002; F02M 27/042; H05H 1/46; H05H 2001/463; Y02T 10/125
USPC ..... 123/594, 406.11, 143 B, 605, 618, 635; 313/231.01–231.71
See application file for complete search history.

(56) References Cited

U.S. PATENT DOCUMENTS 8,240,293 B2 8/2012 Ikeda
2010/0196208 A1* 8/2010 Makita ..... F02P 3/01 422/83

(Continued)

FOREIGN PATENT DOCUMENTS

EP 1347673 A1 9/2003
EP 2180176 A1 4/2010

(Continued)

OTHER PUBLICATIONS

International Search Report dated Jun. 12, 2012, issued in corresponding application No. PCT/JP2012/052170.

*Primary Examiner* — Hai Huynh
*Assistant Examiner* — Gonzalo Laguarda
(74) *Attorney, Agent, or Firm* — Westerman, Hattori, Daniels & Adrian, LLP

(57) ABSTRACT

To suppress the reflection of an electromagnetic wave from a load in a plasma generation device 30 that generates electromagnetic wave plasma by emitting the electromagnetic wave to a combustion chamber 10 of an engine 20. The plasma generation device 30 includes an electromagnetic wave oscillator 33 that oscillates the electromagnetic wave, an antenna 15*a* for emitting the electromagnetic wave oscillated by the electromagnetic wave oscillator to the combustion chamber 10 of the engine 20, and a stub adjustment unit 52, 53. The stub 51 is provided on a transmission line 60 for electromagnetic wave from the electromagnetic wave oscillator 33 to the antenna 15*a*. While the engine 20 is operating, the stub adjustment unit 52, 53 adjusts a short circuit location on the stub 51 based on the intensity of a reflected wave of the electromagnetic wave reflected from the antenna 15*a*.

5 Claims, 7 Drawing Sheets

(51) Int. Cl.

| | |
|---|---|
| ***H05H 1/46*** | (2006.01) |
| *F02P 3/04* | (2006.01) |
| *F02P 9/00* | (2006.01) |
| *F02P 17/00* | (2006.01) |

(56) References Cited

U.S. PATENT DOCUMENTS

2011/0031886 A1* 2/2011 Ikeda ..... F01L 3/02
315/111.21
2014/0014050 A1* 1/2014 Ikeda ..... F02P 9/007
123/3
2014/0076257 A1* 3/2014 Ikeda ..... F02B 23/08
123/143 B
2014/0299085 A1* 10/2014 Ikeda ..... F02B 9/00
123/143 B

FOREIGN PATENT DOCUMENTS

| | | | |
|---|---|---|---|
| JP | 4-256845 | A | 9/1992 |
| JP | 2000-230426 | A | 8/2000 |
| JP | 2002-164198 | A | 6/2002 |
| JP | 2007-113570 | A | 5/2007 |
| JP | 2009-36198 | A | 2/2009 |

* cited by examiner

PLASMA GENERATION DEVICE

TECHNICAL FIELD

The present invention relates to a plasma generation device that generates electromagnetic wave plasma by emitting an electromagnetic wave to a combustion chamber of an engine.

BACKGROUND ART

Conventionally, there is known a plasma generation device that generates electromagnetic wave plasma by emitting an electromagnetic wave to a combustion chamber of an engine. For example, Japanese Unexamined Patent Application, Publication No. 2009-221948 discloses a technique of generating microwave plasma by emitting a microwave from an antenna, while causing a discharge at electrodes of a discharger in a combustion chamber of an engine.

Furthermore, as a method of impedance matching for frequency of microwave band, an open circuit or short circuit stub is employed. Japanese Unexamined Patent Application, Publication No. 2004-7248 and Japanese Unexamined Patent Application, Publication No. 1995-153599 disclose methods of mechanically adjusting insert amount of a stub as a method of stub adjustment in accordance with load variation. Furthermore, Japanese Unexamined Patent Application, Publication No. 2007-174064 and Japanese Unexamined Patent Application, Publication No. 2009-268004 disclose an adjustment unit of the open circuit stub.

THE DISCLOSURE OF THE INVENTION

Problems to be Solved by the Invention

In a plasma generation device that generates electromagnetic wave plasma by emitting an electromagnetic wave to a combustion chamber of an engine, load impedance, seen from an electromagnetic wave oscillator, greatly changes before and after the plasma generation, and even after the plasma generation, in accordance with a state of plasma. Since the plasma is instantaneously generated, the load impedance rapidly changes before and after the plasma generation. Especially in the combustion chamber of the engine, since temperature and pressure rapidly change, the load impedance also changes rapidly. It is impossible to adjust the impedance matching following a rapid load variation by means of, for example, a stub mechanism that mechanically adjusts the impedance matching.

For this reason, in conventional plasma generation devices, an isolator has been employed to prevent influence of a reflected wave generated due to mismatching, and an electromagnetic wave oscillator, which has ample output power, has been employed so as to make it possible to generate electromagnetic wave plasma even if a mismatch might occur to a certain extent.

The present invention has been made in view of the above described circumstances, and it is an object of the present invention to suppress the reflection of an electromagnetic wave on a transmission line from a load on a side of electromagnetic wave plasma in a plasma generation device that generates electromagnetic wave plasma by emitting the electromagnetic wave to a combustion chamber of an engine.

Means for Solving the Problems

In accordance with a first aspect of the present invention, there is provided a plasma generation device including: an electromagnetic wave oscillator that oscillates an electromagnetic wave; and an antenna for emitting the electromagnetic wave oscillated by the electromagnetic wave oscillator to a combustion chamber of an engine, wherein the plasma generation device generates electromagnetic wave plasma by way of the electromagnetic wave emitted from the antenna to the combustion chamber, the plasma generation device further includes a stub provided on a transmission line for electromagnetic wave from the electromagnetic wave oscillator to the antenna, and a stub adjustment unit that adjusts, while the engine is operating, a short circuit location on the stub based on intensity of a reflected wave of the electromagnetic wave reflected from the antenna.

According to the first aspect of the present invention, the stub is provided on the transmission line for electromagnetic wave, and the short circuit location on the stub is adjusted while the engine is operating based on the intensity of the reflected wave reflected from the antenna (the reflected wave reflected from a load on a side of the antenna).

In accordance with a second aspect of the present invention, in addition to the first aspect of the present invention, the stub adjustment unit includes a plurality of switches each having one end connected to the stub and other end connected to a ground, the switches being spaced apart from one another at a distance in a longitudinal direction of the stub, and a switch control device that performs a short circuit location adjustment operation of, while changing the switch to be brought to conductive state one after another, finding a switch that minimizes the intensity of the reflected wave, and short-circuiting the stub via the switch thus found.

According to the second aspect of the present invention, from among the plurality of switches arranged between the stub and the ground, the switch that can minimize the reflected wave in intensity is found, and the stub is short-circuited via the switch thus found, thereby adjusting the short circuit location on the stub.

In accordance with a third aspect of the present invention, in addition to the second aspect of the present invention, from among the plurality of switches, a plurality of switches arranged from a predetermined location on the stub toward a side of the transmission line constitute a first switch group, and the rest of the switches constitute a second switch group, in the short circuit location adjustment operation, the switch control device compares the reflected waves in intensity respectively acquired by bringing each of two switches located on both sides of a boundary between the first and second switch groups to conductive state, so as to search for a switch that minimizes the intensity of the reflected wave from the switch group, which the switch that causes the intensity of the reflected wave less than the other belongs to.

According to the third aspect of the present invention, it is determined which switch group includes the switch that can minimize the reflected wave in intensity by comparing the reflected waves in intensity respectively acquired by bringing each of two switches located on both sides of the boundary to conductive state, from among the first and second switch groups.

In accordance with a fourth aspect of the present invention, in addition to the third aspect of the present invention, from among the plurality of switches, one of the two switches respectively located on both sides of the boundary between the first and second switch groups is connected to the stub at a location distance from the transmission line approximately by a quarter of the wavelength.

In accordance with a fifth aspect of the present invention, in addition to the first aspect of the present invention, the stub adjustment unit includes a plurality of switches each having one end connected to the stub and other end connected to a ground, the switches being spaced apart from one another at a distance in a longitudinal direction of the stub, and a switch control device that, while changing the switch to be brought to conductive state one after another, finds a switch that causes the intensity of the reflected wave less than a predetermined threshold, and short-circuits the stub via the switch thus found.

According to the fifth aspect of the present invention, from among the plurality of switches arranged between the stub and the ground, the switch that causes the intensity of the reflected wave less than a predetermined threshold is found, and the stub is short-circuited via the switch thus found.

Effect of the Invention

According to the present invention, while the engine is operating, the short circuit location is adjusted on the stub based on the intensity of the reflected wave from the antenna. Therefore, it is possible to suppress the reflection of the electromagnetic wave from the antenna.

In a case of adjusting impedance by variable electric length of the stub, experienced operation has been required each time in order to make an unspecified and changeable load impedance matched. However, according to the present invention, since the short circuit location is automatically adjusted based on the intensity of the reflected wave, it is possible to optimally adjust the impedance to be matched with the load.

Furthermore, in a case of impedance adjustment for a high power transmission line, it is difficult to employ a micro structure device such as an MEMS (Micro Electro Mechanical Systems) switch. However, in the present invention, without employing such a device, it is possible to realize impedance adjustment for a high power transmission line by adjusting the short circuit location on the stub.

According to the third aspect of the present invention, it is firstly determined which switch group includes the switch that minimizes the reflected wave in intensity. Here, it is time consuming to conduct a method of searching for the switch that minimizes the intensity of the reflected wave by bringing all of the switches to conductive state one after another. Therefore, if the number of the switches increases to some extent, it takes too much time, in relation to the engine operation, to find the switch to be short-circuited. On the other hand, according to the third aspect of the present invention, a search range is firstly narrowed to either one of the switch groups, and then the switch that minimizes the reflected wave in intensity is searched for. Accordingly, it is possible to quickly find an optimum short circuit location, and to quickly adjust the impedance matching with the load with a simple control algorithm. In addition, a finer impedance adjustment is possible by increasing the number of switches.

Furthermore, according to the fifth aspect of the present invention, from among the plurality of switches, the switch is found that causes the intensity of the reflected wave lower than the predetermined threshold value, and the stub is short-circuited by the switch thus found. Accordingly, if the threshold value is properly set, it is possible to quickly adjust the short circuit location. Even in a case in which a condition of the combustion chamber of the engine rapidly changes, it is possible to properly determine the short circuit location.

BEST MODE FOR CARRYING OUT THE INVENTION

In the following, a detailed description will be given of the embodiment of the present invention with reference to drawings. It should be noted that the following embodiment is a mere example that is essentially preferable, and is not intended to limit the scope of the present invention, applied field thereof, or application thereof.

The present embodiment is directed to a plasma generation device 30 according to the present invention. The plasma generation device 30 generates microwave plasma by emitting a microwave to a combustion chamber 10 of an engine 20. In the following, the engine 20 is described first, and then, the plasma generation device 30 is described in detail.

<Engine>

The engine 20 is a reciprocal type engine, in which a piston 23 reciprocates. The engine 20 is mounted on a vehicle, for example.

Figure 1:
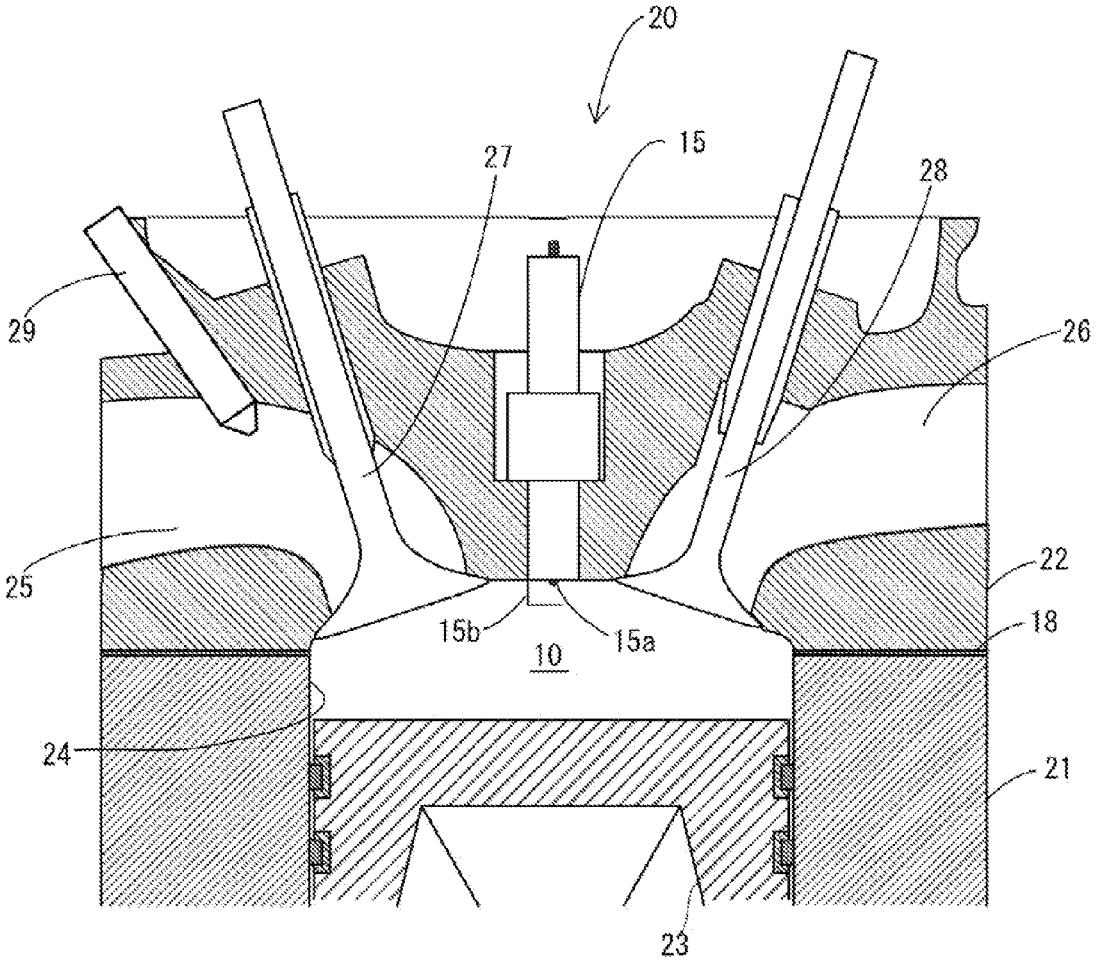
FIG. 1 is a schematic longitudinal cross sectional view of an engine according to an embodiment.

As shown in FIG. 1, the engine 20 is provided with a cylinder block 21, a cylinder head 22, and the piston 23. The cylinder block 21 is formed with a plurality of cylinders 24 each having circular cross sections. Inside of each cylinder 24, the piston 23 is slidably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocation movement of the piston 23 into rotation movement of the crankshaft.

The cylinder head 22 is placed on the cylinder block 21, and a gasket 18 intervenes between the cylinder block 21 and the cylinder head 22. The cylinder head 22 partitions the combustion chamber 10 along with the cylinder 24 and the piston 23. The cylinder head 22 is provided with one spark plug 15 for each cylinder 24. The spark plug 15 includes a central electrode 15*a* and a ground electrode 15*b*, between which a discharge gap is formed. The cylinder head 22 is formed with an intake port 25 and an exhaust port 26 for each cylinder 24. The intake port 25 is provided with an intake valve 27 and an injector 29, while, on the other hand, the exhaust port 26 is provided with an exhaust valve 28.

<Plasma Generation Device>

Figure 2:
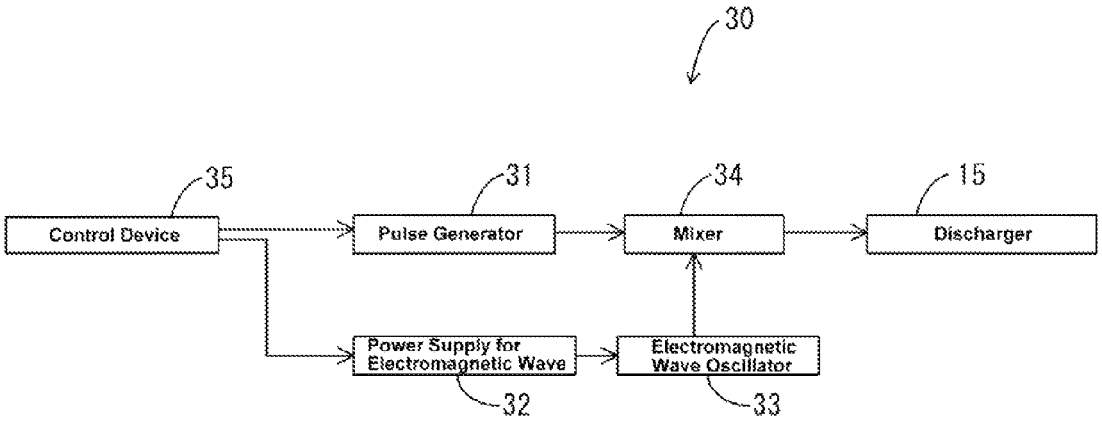
FIG. 2 is a block diagram of a plasma generation device according to the present embodiment.
Figure 3:
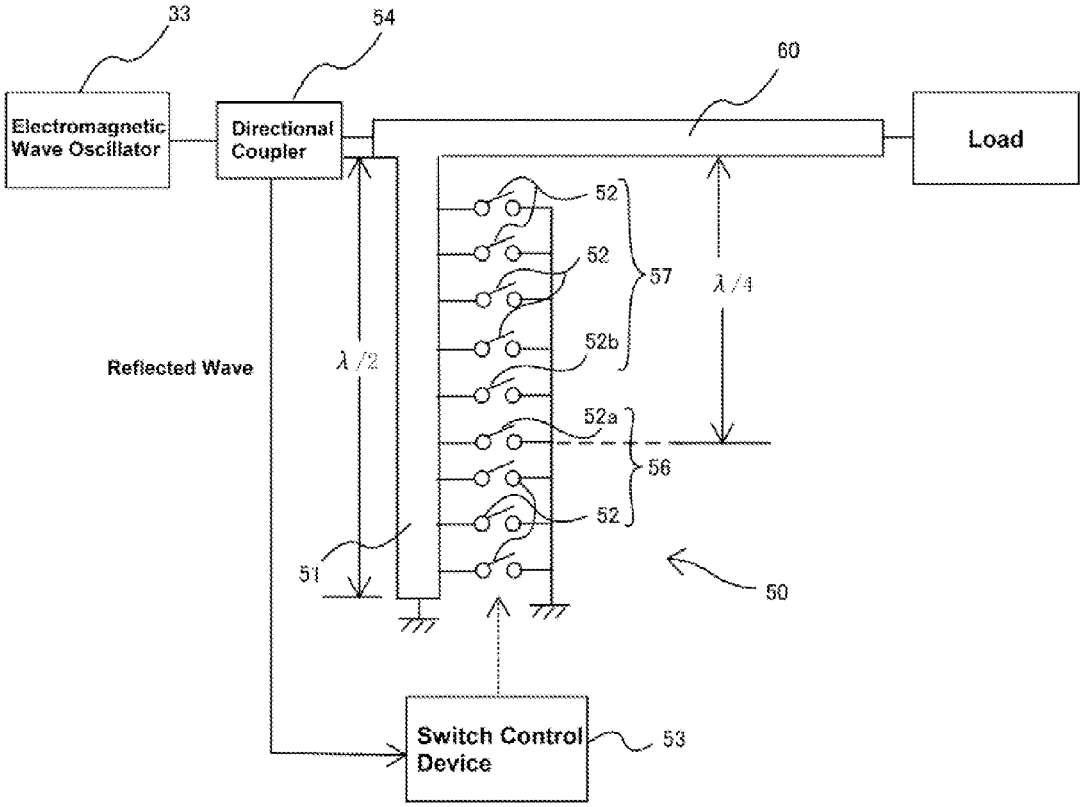
FIG. 3 is a schematic configuration diagram of an impedance matching device according to the present embodiment.

As shown in FIG. 2, the plasma generation device 30 is provided with a pulse generator 31, a power supply for electromagnetic wave 32, an electromagnetic wave oscillator 33, a mixer 34, a discharger 15, and an antenna 15*a* for electromagnetic wave. Also, as shown in FIG. 3, the plasma generation device 30 is provided with an impedance matching device 50 that performs impedance matching with a load.

The pulse generator 31 is connected to, for example, a direct current power supply (not shown). The pulse generator 31 is, for example, an ignition coil. The pulse generator 31, upon receiving an ignition signal from a control device 35, boosts a voltage applied from the direct current power supply, and outputs the boosted high voltage pulse to the mixer 34.

The power supply for electromagnetic wave 32 is connected to, for example, a direct current power supply (not shown). The power supply for electromagnetic wave 32, upon receiving an electromagnetic wave drive signal from the control device 35, converts a current from the direct current power supply to a pulse current, and outputs it to the electromagnetic wave oscillator 33. The electromagnetic wave oscillator 33 is, for example, a magnetron or a semiconductor oscillator. The electromagnetic wave oscillator 33, upon receiving the pulse current, outputs a microwave pulse to the mixer 34. The mixer 34 mixes the high voltage pulse and the microwave pulse and outputs them to the discharger 15.

The discharger 15 is the spark plug 15 of the engine 20. In the spark plug 15, the central electrode 15*a* is electrically connected to the mixer 34. The spark plug 15, upon receiving the high voltage pulse and the microwave pulse from the mixer 34, causes a spark discharge at the discharge gap, and discharge plasma generated by the spark discharge is irradiated with the microwave from the central electrode 15*a*. The central electrode 15*a* functions as the antenna for electromagnetic wave. The discharge plasma generated by the spark discharge absorbs energy of the microwave and expands. In this manner, the plasma generation device 30 generates non-equilibrium plasma.

The power supply for electromagnetic wave 32 outputs the pulse current for a predetermined time interval (1 ms, for example) at a predetermined duty cycle. The electromagnetic wave oscillator 33 outputs the microwave pulse during the time interval. When the time interval has elapsed since a rise time of the microwave pulse, the microwave pulse oscillation is terminated, and the microwave plasma disappears.

<Impedance Matching Device>

As shown in FIG. 3, the impedance matching device 50 includes a stub 51 provided on a transmission line 60 for electromagnetic wave from the electromagnetic wave oscillator 33 and the load (the load on a side of the microwave plasma), a plurality of switches 52 connected to the stub 51, and a switch control device 53 that controls the plurality of switches 52 according to a measurement result of intensity of a reflected wave of the microwave reflected from the antenna 15*a* (a reflected wave reflected from the load on a side of the antenna 15*a*). The reflected wave is inputted by means of a directional coupler 54 to the switch control device 53. The plurality of switches 52 and the switch control device 53 constitutes a stub adjustment unit that adjusts a short circuit location on the stub 51 based on the intensity of the reflected wave of the microwave reflected from the load, while the engine 20 is operating.

The stub 51 is a short circuit stub 51, connected to the transmission line 60 for electromagnetic wave from the electromagnetic wave oscillator 33 to the antenna 15*a*. A length of the short circuit stub 51 is one half of a wavelength λ (electric length) of the microwave on the stub 51.

The plurality of switches 52 are connected in parallel between the stub 51 and a grounding surface (the ground). The plurality of switches 52 are equidistantly arranged in a longitudinal direction of the stub 51.

From among the plurality of switches 52, a plurality of switches arranged from a predetermined location on the stub 51 toward a side of the transmission line 60 constitute a first switch group 56, and the rest of the switches 52 constitute a second switch group 57. More particularly, the first switch group 56 is constituted by the plurality of switches 52 arranged from a reference switch 52*a* toward the side of the transmission line 60 including the reference switch 52*a* wherein the "reference switch 52*a*" is intended to mean a switch that is connected to the stub 51 at a location distance from the transmission line 60 approximately by a quarter of the wavelength (electric length) of the microwave on the stub 51. The second switch group 57 is constituted by a plurality of switches 52 arranged further away from the transmission line 60 than the reference switch 52*a*. In the second switch group 57, a switch adjacent to the reference switch 52*a* is hereinafter referred to as an "adjacent switch 52*b*".

The switch control device 53 performs a short circuit location adjustment operation of determining a switch 52, which can minimize the reflected wave in intensity (hereinafter, referred to as a "reflection intensity minimizing switch") from among the switches 52 by changing the switch 52 to be brought to conductive state from one after another, and specifying the switch 52 thus determined as the switch 52 to be short-circuited (hereinafter, referred to as an "eventual short circuit switch"). During the short circuit location adjustment operation, the switch control device 53 brings each of two switches 52 (the reference switch 52*a* and the adjacent switch 52*b*) located on both sides of a boundary between the first and second switch groups 56 and 57 to conductive state, measures and compares the reflected waves in intensity respectively so as to determine which of the switches 52*a* and 52*b* causes the intensity of the reflected wave less than the other. In this manner, the switch control device 53 searches for the reflection intensity minimizing switch 52 from among the switch group 56 or 57 to which the determined switch 52*a* or 52*b* belongs.

Figure 4:
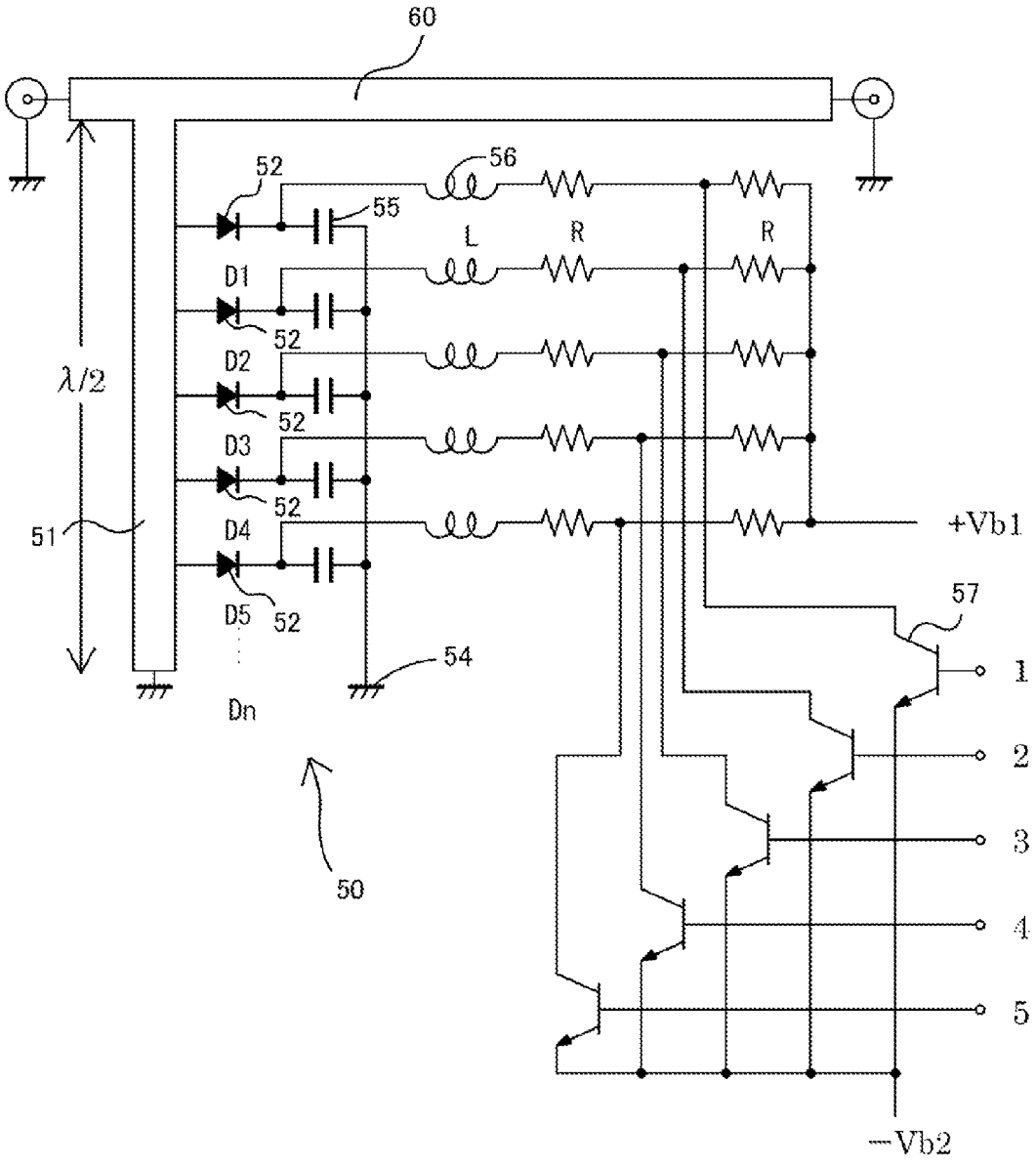
FIG. 4 is a configuration diagram showing a particular example of the impedance matching device according to the present embodiment.

As shown in FIG. 4, a PIN (P-Intrinsic-N) diode may be employed as each switch 52. The transmission line 60 and the stub 51 are striplines formed on a substrate. Each PIN diode 52 is connected in series with a capacitor 55 between a line of the stub 51 and a ground pattern 54. A bias voltage is applied to each PIN diode at a cathode thereof via a coil 56. The PIN diode 52 is brought to conductive (ON) state when a negative voltage is applied as the bias voltage, and is brought to non-conductive (OFF) state when a positive voltage is applied as the bias voltage.

The bias voltage is switched between positive and negative by switching ON and OFF a transistor 57 connected to each PIN diode 52. A control signal outputted from the switch control device 53 is inputted to each transistor 57 at a base thereof. When the control signal is applied to the transistor 57 at the base and then the transistor 57 is brought to conductive state, the cathode potential of the PIN diode 52 connected to the conductive transistor 57 becomes negative and then the concerned PIN diode 52 is brought into conductive state. On the other hand, when the transistor 57 is in non-conductive state, the cathode potential of the PIN diode 52 connected to the non-conductive transistor 57 is positive and, therefore, the concerned PIN diode 52 is in non-conductive state. In this manner, it is possible to bring the PIN diode 52 to conductive or non-conductive state by applying or not applying the control signal, thereby making it possible to change a length operative in the stub 51 (hereinafter, referred to as an "operative length of the stub 51"). The operative length of the stub 51 is a distance between the transmission line 60 and the conductive switch 52.

The transistor 57 and the PIN diode 52 are semiconductor devices, and capable of realizing switching speeds of microsecond order. For example, assuming that 2.4 GHz of ISM (Industrial, Scientific and Medical) band is selected as the microwave frequency, a half wavelength is approximately 60 mm. If the PIN diode is integrated in a chip shape of 2 mm wide, up to thirty PIN diodes 52 can be arranged on the stub 51. According to a control sequence shown in FIG. 5, which will be described later, it is possible to determine the optimum short circuit location by up to sixteen times of measurement of the reflected wave. Assuming that it takes tens of microseconds for each measurement, it is possible to complete the adjustment within a millisecond.

An impedance Z of the short circuit stub 51 can be expressed as shown in equation (1).

$$Z=jZo\cdot\tan\beta L \quad (1)$$

Figure 6:
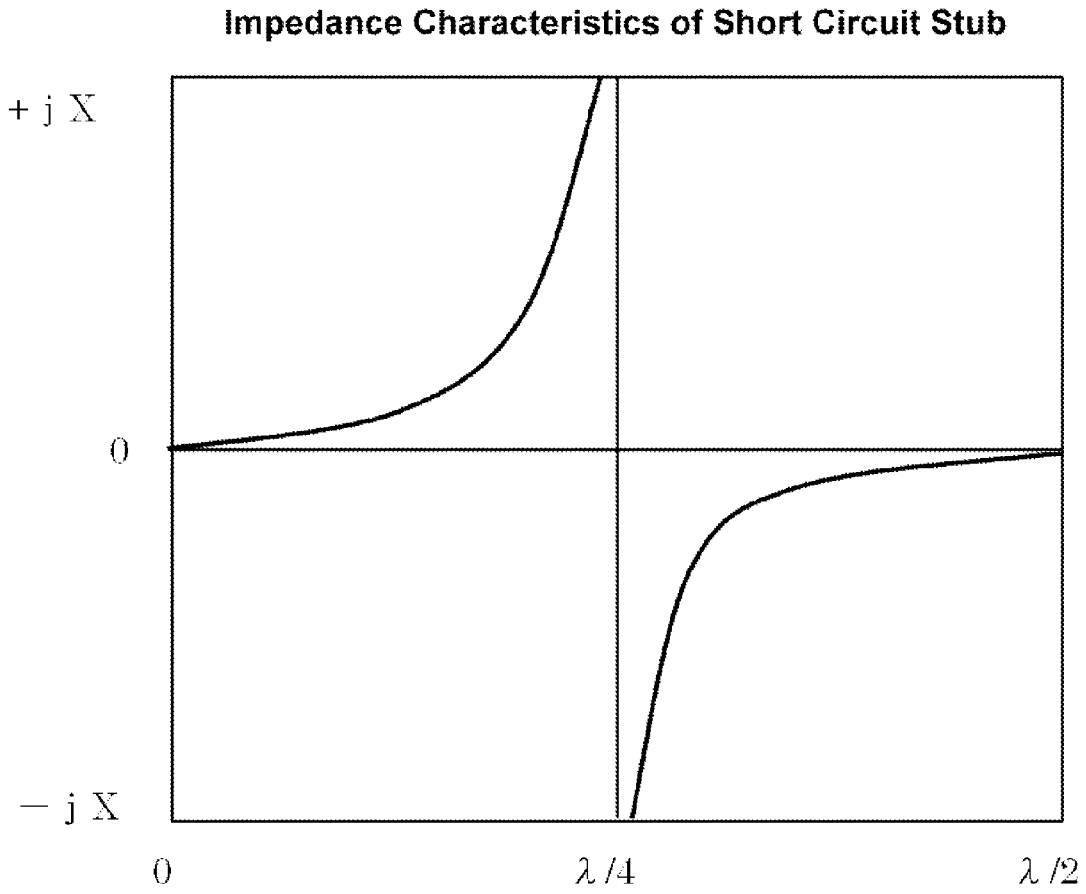
FIG. 6 is a graph illustrating an impedance characteristic of a short circuit stub.

In equation (1), L represents the electric length of the stub 51, Zo represents a characteristic impedance of the transmission line, and $\beta=2\pi/\lambda$. As shown in FIG. 6, Z is infinite at $L=\lambda/4$, and is zero at $L=\lambda/2$.

Figure 7:
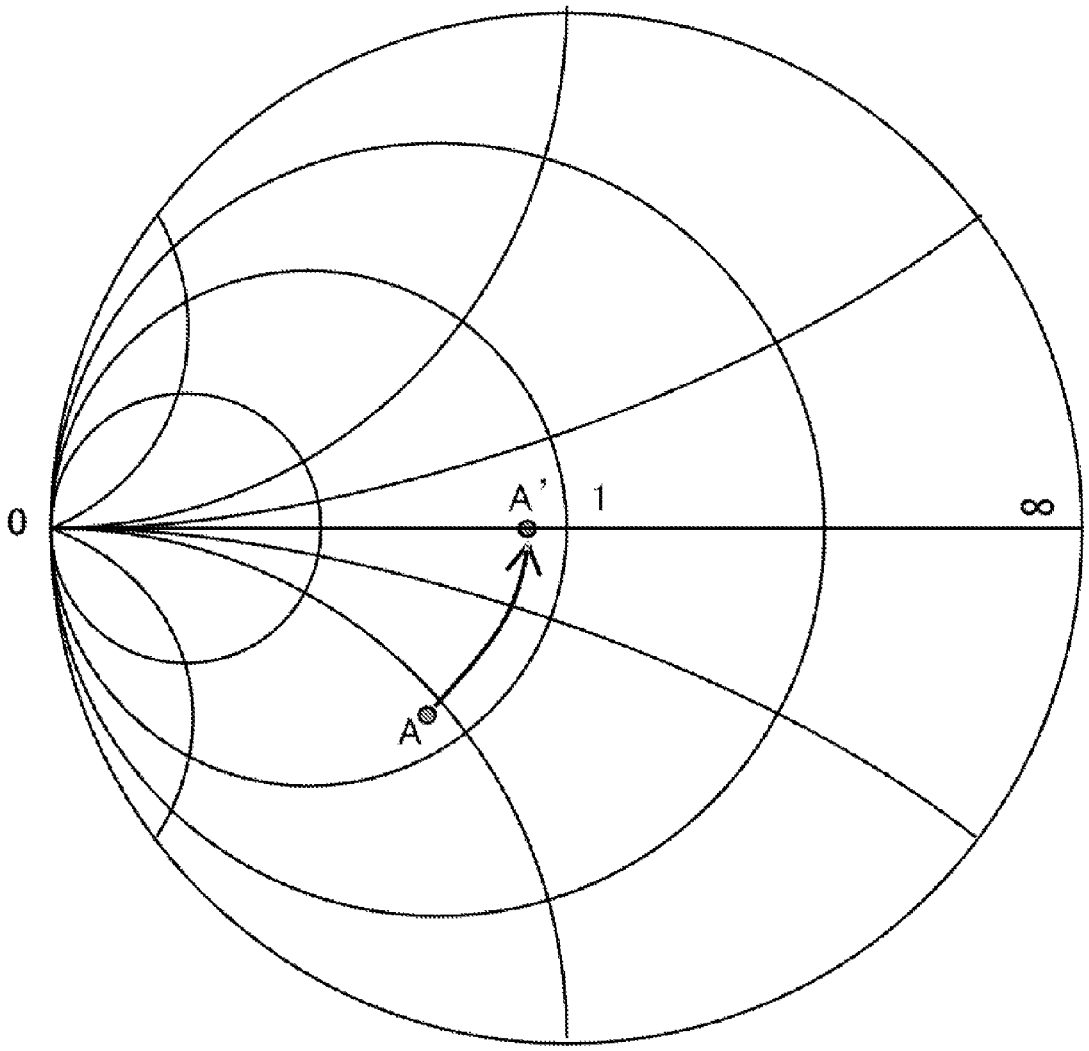
FIG. 7 is a Smith chart illustrating impedance matching by means of the short circuit stub.

Adjustment by short circuit stub 51 will be described hereinafter with reference to a Smith chart shown in FIG. 7. In a case in which the stub 51 is connected in parallel to the same location as a measuring point, the impedance, as a load seen from the measuring point, will move on an equal conductance circle on an admittance chart.

For example, it is assumed that the load impedance is represented by a point A when the operative length of the stub 51 is a quarter wavelength (wavelength of the microwave on the stub 51). The point A will move on the equal conductance circle in a counterclockwise direction as the operative length of the stub 51 is made shorter than the quarter wavelength while, on the other hand, the point A will move in a clockwise direction as the operative length of the stub 51 is made longer than the quarter wavelength. The point A will eventually reach to a point A' where susceptance is zero as the operative length of the stub 51 is made shorter than the quarter wavelength. The point A' is a point where impedance matching is optimally attained.

<Short Circuit Location Adjustment Operation of Impedance Matching Device>

The short circuit location adjustment operation of the impedance matching device 50 will be described hereinafter with reference to FIG. 5. The short circuit location adjustment operation is performed each combustion cycle when the microwave plasma is generated in the combustion chamber 10 of the engine 20.

Figure 5:
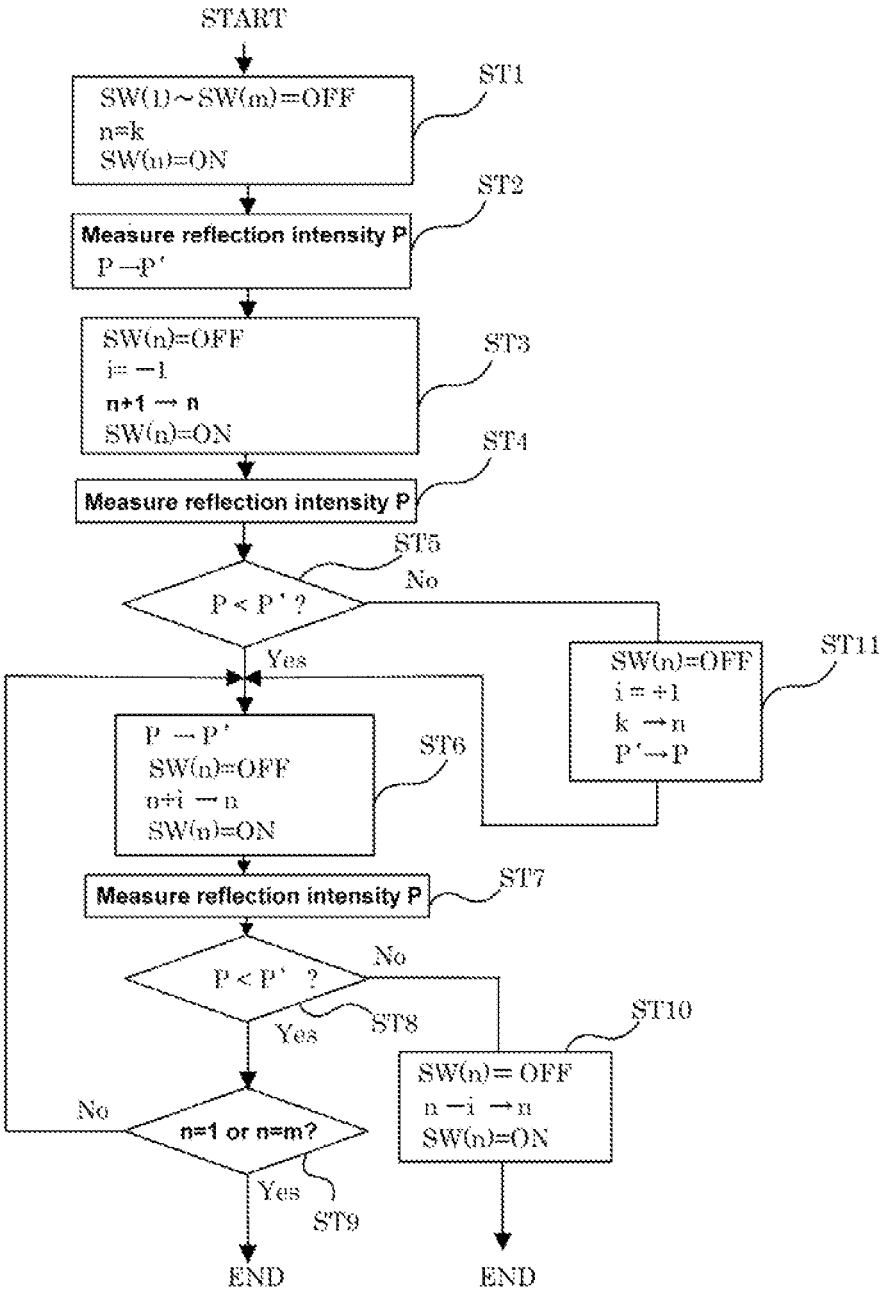
FIG. 5 is a flowchart showing a control algorithm of the impedance matching device according to the present embodiment.

In FIG. 5, n represents a switch number assigned to each switch 52 in order from the side of the transmission line 60. The reference switch 52*a* is the k-th switch. The stub 51 is provided with m switches 52.

In Step ST1, from a state in which all of the switches 52 are OFF, only the reference switch 52*a* is turned ON. This means that the stub 51 is short-circuited at a quarter wavelength location. In Step ST2, a measurement is made of intensity P' of the reflected wave reflected from the load. Hereinafter, the intensity P' measured in Step ST2 is referred to as a "first reflection intensity".

In Step ST3, the reference switch 52*a* is returned to OFF, and the adjacent switch 52*b* alone is turned ON. In Step ST4, a measurement is made of intensity P of the reflected wave. Hereinafter, the intensity P measured in Step ST4 is referred to as a "second reflection intensity". Subsequently, in Step ST5, a comparison is made between the first reflection intensity P' and the second reflection intensity P.

In a case in which the first reflection intensity P' is less than the second reflection intensity P (in a case of "Yes" in FIG. 5) as a result of the comparison in Step ST5, it is determined that the load impedance is plotted on the lower half of the Smith chart, and the reflection intensity minimizing switch 52 belongs to the first switch group 56. In this case, following Step ST5, Steps ST6 to ST10 are performed. During steps ST6 to ST10, while the switch 52 to be short-circuited is changed one after another toward the transmission line 60 so that the operative length of the stub 51 is gradually shortened until the reflection intensity minimizing switch 52 is found. The reflection intensity minimizing switch 52 thus found is determined to be the eventual short circuit switch in this case of short circuit location adjustment operation.

On the other hand, in a case in which the first reflection intensity P' is greater than the second reflection intensity P (in the case of "No" in FIG. 5) as a result of the comparison in Step ST5, it is determined that the load impedance is plotted on the upper half of the Smith chart, and the reflection intensity minimizing switch 52 belongs to the second switch group 57. In this case, following Step ST5, Step ST11 is performed, and then Steps ST6 to ST10 are performed. During steps S6 to S10, while the switch 52 to be short-circuited is changed one after another in order gradually away from the transmission line 60 so that the operative length of the stub 51 is gradually increased until the reflection intensity minimizing switch 52 is found. The reflection intensity minimizing switch 52 thus found is determined to be the eventual short circuit switch in this case of short circuit location adjustment operation.

<In Case it is Determined "YES" in Step ST5>

In Step ST6, the switch 52, which is arranged immediately adjacent to the previously short-circuited switch 52 in a direction toward the side of the transmission line 60, is short-circuited, and, in Step ST7, a measurement is made of intensity of the reflected wave. In Step ST8, a comparison is made between the measured intensity P of the reflected wave and the previously measured intensity P' of the reflected wave.

As a result of the comparison in Step ST8, in a case in which the intensity P of the reflected wave measured in Step ST7 is lower than the other (in the case of "Yes" in FIG. 5), control proceeds to Step ST9. In Step ST9, it is determined whether or not the short-circuited switch 52 in Step ST6 is arranged at either end (the first or the m-th switch). If it is determined to be "No", control goes back to Step ST6 and Step ST6 is performed again. While changing the short circuit location one switch 52 after another in a direction toward the side of the transmission line 60, the reflection intensity minimizing switch 52 is searched for. Meanwhile, if it is determined that the short-circuited switch 52 in Step ST6 is the switch 52 arranged at either end, the switch 52 is determined to be the reflection intensity minimizing switch 52 and, therefore, the eventual short circuit switch in this case of short circuit location adjustment operation.

On the other hand, as a result of the comparison in Step ST8, in a case in which the intensity P of the reflected wave measured in Step ST7 is greater than the other (in the case of "No" in FIG. 5), control proceeds to Step ST10. In Step ST10, the switch 52 short-circuited in Step ST6 is turned OFF, and the switch 52 short-circuited in of Step ST6 of the previous turn is turned ON. Then, the switch 52 short-circuited in Step ST6 of the previous turn is determined to be the reflection intensity minimizing switch 52 and, therefore, the eventual short circuit switch in this case of short circuit location adjustment operation.

<In Case in which it is Determined "No" in Step ST5>

In this case, a variable i (increment value of n) is set to +1, and n is set to k in Step ST11, the operation is changed as follows. In Step ST6, the switch 52, which is arranged immediately adjacent to the reference switch 52*a* in a direction away from the transmission line 60, is short-circuited, and, in Step ST7, a measurement is made of intensity of the reflected wave. In Step ST8, a comparison is made between the intensity P of the reflected wave measured in Step ST7 and the intensity P' (the first reflection intensity) of the reflected wave when the reference switch 52*a* is short-circuited.

In a case in which Step ST6 is repeatedly performed according to a determination in Step ST9, which will be described later, a comparison is made in Step ST8 between the intensity P of the reflected wave measured in Step ST7 and the previously measured reflection intensity P'.

As a result of the comparison in Step ST8, in a case in which the reflection intensity P measured in Step ST7 is lower than the other (in the case of "Yes" in FIG. 5), control proceeds to Step ST9. In Step ST9, it is determined whether or not the switch 52 short-circuited in Step ST6 is arranged at either end, and if it is determined "No", control goes back to Step ST6.

Then, Step ST6 is repeatedly performed, and, while changing the short circuit location one switch 52 after another in a direction away from the transmission line 60, the reflection intensity minimizing switch 52 is searched for. If it is determined, in Step ST9, that the switch 52 short-circuited in Step ST6 is arranged at either end, the switch 52 is determined to be the reflection intensity minimizing switch and, therefore, the eventual short circuit switch in this case of short circuit location adjustment operation.

On the other hand, as a result of the comparison in Step ST8, in a case in which the reflection intensity P measured in Step ST7 is higher than the other (in the case of "No" in FIG. 5), control proceeds to Step ST10. In Step ST10, the switch 52 short-circuited in Step ST6 is turned OFF. If Step ST6 has been performed only once, the reference switch 52*a* is turned ON, while, on the other hand, if Step ST6 has been performed more than once, the switch 52 short-circuited in Step ST6 of the previous turn is turned ON. The switch 52 short-circuited in Step ST10 is determined to be the eventual short circuit switch in this case of the short circuit location adjustment operation.

Effect of Embodiment

In the present embodiment, while the engine 20 is operating, the short circuit location on the stub 51 is adjusted based on the intensity of the reflected wave of the microwave reflected from the load. Accordingly, it is possible to suppress the reflection of the microwave.

Furthermore, in the present embodiment, since the short circuit location is adjusted based on the intensity of the reflected wave, it is possible to automatically optimize the impedance matching with the load.

Furthermore, in the present embodiment, there is no need of employing a microstructure device such as an MEMS (Micro Electro Mechanical Systems) switch in order to realize impedance adjustment on a high-power transmission line 60.

Furthermore, in the present embodiment, it is firstly determined which of the switch groups 56 and 57 the reflection intensity minimizing switch 52 belongs to. After a search range is narrowed to either one of the switch groups 56 and 57, the reflection intensity minimizing switch 52 is searched for. Accordingly, it is possible to find the optimum short circuit location in a short time, and it is possible to quickly adjust the impedance matching with the load with a simple control algorithm. Furthermore, a finer impedance adjustment can be realized by increasing the number of the switches 52.

First Modified Example of Embodiment

The following description is directed to a first modified example of the present embodiment. In the first modified example, immediately after the engine 20 started to operate, the short circuit location adjustment operation is performed so that the eventual short circuit switch 52 is determined. After then on, the short circuit location adjustment operation is not performed, and the state of impedance matching that has been determined immediately after the engine 20 started to operate is maintained.

During the short circuit location adjustment operation, the plasma generation device 30 reduces an amount of energy per unit time of the microwave emitted to the combustion chamber 10 to a value less than an ordinary value (a value when the short circuit location adjustment operation is not performed). After the short circuit location adjustment operation, the amount of energy per unit time of the microwave emitted to the combustion chamber 10 is resumed to the ordinary value. As a result of this, it is possible to prevent the switch 52 from being damaged due to excessive energy of the reflected wave.

The short circuit location adjustment operation may be performed each time the output of the engine 20 is changed to a predetermined value. During the short circuit location adjustment operation, the plasma generation device 30 reduces the amount of energy per unit time of the microwave emitted to the combustion chamber 10 to a value less than the ordinary value.

Second Modified Example of Embodiment

The following description is directed to a second modified example of the present embodiment. In the short circuit location adjustment operation according to the second modified example, if the number of the switches 52 that has been short-circuited exceeds a predetermined value, the search for the reflection intensity minimizing switch 52 is abandoned, and the stub control device 53 finds out the switch 52 which causes the intensity of the reflected wave below a predetermined threshold value, and short-circuits the stub 51 via the switch 52 thus found.

Since temperature and pressure rapidly change in the combustion chamber 10 of the engine 20, even if the same switch 52 is short-circuited, the intensity of the reflected wave might be changed rapidly. Therefore, there is a risk that the short circuit location adjustment operation may not converge and terminate if the short circuit location adjustment operation is configured to continue as long as the reflection intensity minimizing switch 52 is not found. In the second modified example, in order to prevent the short circuit location adjustment operation from endlessly continuing, the short circuit location adjustment operation is configured to change to a control algorithm in a middle of the short circuit location adjustment operation, wherein the control algorithm determines the switch 52 that causes the intensity of the reflected wave below a predetermined threshold value to be the eventual short circuit switch 52.

Third Modified Example of Embodiment

The following description is directed to a third modified example of the present embodiment. In the third modified example, the stub control device 53, while changing the switch 52 to be brought to conductive state one after another, if the switch 52, which causes the intensity of the reflected wave below the predetermined threshold value, is found, short-circuits the stub 51 via the switch 52 thus found.

Accordingly, by properly setting the threshold value, it is possible to rapidly adjust the short circuit location. Furthermore, even in a case in which a condition of the combustion chamber 10 of the engine 20 rapidly changes, it is possible to properly determine the short circuit location.

Other Embodiments

The above described embodiment may also be configured as follows.

In the embodiment described above, the high voltage pulse and the microwave may be applied to separate locations. In this case, an antenna for emitting electromagnetic wave is provided separately from the central electrode 15*a* of the spark plug 15. Without requiring the mixer 34, the pulse generator 31 is directly connected to the spark plug 15, and the electromagnetic wave oscillator 33 is directly connected to the antenna for emitting electromagnetic wave. The antenna for emitting electromagnetic wave may be internally integrated with the spark plug 15, and may be provided on the cylinder head 22 separately from the spark plug 15.

Furthermore, although, in the embodiment described above, the engine 20 is a spark ignition engine, the engine 20 may be of different type such as a diesel engine.

INDUSTRIAL APPLICABILITY

The present invention is useful in relation to a plasma generation device that generates electromagnetic wave plasma by emitting an electromagnetic wave to a combustion chamber of an engine.

EXPLANATION OF REFERENCE NUMERALS

10 Combustion Chamber
15*a* Antenna
20 Engine
30 Plasma Generation Device
33 Electromagnetic Wave Oscillator
51 Stub
52 Switch (Stub Adjustment Unit)
53 Switch Control Device (Stub Adjustment Unit)
60 Transmission Line

What is claimed is:

1. A plasma generation device, comprising: an electromagnetic wave oscillator that oscillates an electromagnetic wave; and an antenna for emitting the electromagnetic wave oscillated by the electromagnetic wave oscillator to a combustion chamber of an engine, and a sensor which measures intensity of a reflected wave of the electromagnetic wave reflected from the antenna, wherein the plasma generation device generates electromagnetic wave plasma by way of the electromagnetic wave emitted from the antenna to the combustion chamber, the plasma generation device further includes a stub provided on a transmission line for electromagnetic wave from the electromagnetic wave oscillator to the antenna, and a stub adjustment unit that adjusts, while the engine is operating, a short circuit location on the stub based on the intensity of a reflected wave of the electromagnetic wave reflected from the antenna.

2. The plasma generation device according to claim 1, wherein the stub adjustment unit includes a plurality of switches each having one end connected to the stub and other end connected to a ground, the switches being spaced apart from one another at a distance in a longitudinal direction of the stub, and a switch control device that performs a short circuit location adjustment operation of, while changing the switch to be brought to conductive state one after another, finding a switch that minimizes the intensity of the reflected wave, and short-circuiting the stub via the switch thus found.

3. The plasma generation device according to claim 2, wherein from among the plurality of switches, a plurality of switches arranged from a predetermined location on the stub toward a side of the transmission line constitute a first switch group, and the rest of the switches constitute a second switch group, in the short circuit location adjustment operation, the switch control device compares the reflected waves in intensity respectively acquired by bringing each of two switches located on both sides of a boundary between the first and second switch groups to conductive state, so as to search for a switch that minimizes the intensity of the reflected wave from the switch group, which the switch that causes the intensity of the reflected wave less than the other belongs to.

4. The plasma generation device according to claim 3, wherein, from among the plurality of switches, one of the two switches respectively located on both sides of the boundary between the first and second switch groups is connected to the stub at a location distance from the transmission line approximately by a quarter of the wavelength.

5. The plasma generation device according to claim 1, wherein the stub adjustment unit includes:

a plurality of switches each having one end connected to the stub and other end connected to a ground, the switches being spaced apart from one another at a distance in a longitudinal direction of the stub; and a switch control device that, while changing the switch to be brought to conductive state one after another, finds a switch that causes the intensity of the reflected wave less than a predetermined threshold, and short-circuits the stub via the switch thus found.

* * * * *